US007455293B2

(12) United States Patent
Shimizu et al.

(10) Patent No.: US 7,455,293 B2
(45) Date of Patent: Nov. 25, 2008

(54) SHEET HANDLING MACHINE

(75) Inventors: Yasuhiro Shimizu, Otsu (JP); Koichi Hamada, Kusatsu (JP); Takeshi Nakamura, Otsu (JP); Hidetoshi Hata, Ritto (JP)

(73) Assignee: Hitachi-Omron Terminal Solutions Corp., Tokyo (JP)

( * ) Notice: Subject to any disclaimer, the term of this patent is extended or adjusted under 35 U.S.C. 154(b) by 0 days.

(21) Appl. No.: 12/071,202

(22) Filed: Feb. 19, 2008

(65) Prior Publication Data

US 2008/0150224 A1 Jun. 26, 2008

Related U.S. Application Data

(62) Division of application No. 11/067,924, filed on Mar. 1, 2005.

(30) Foreign Application Priority Data

Mar. 2, 2004 (JP) ..... 2004-057541

(51) Int. Cl.
*B65H 7/02* (2006.01)

(52) U.S. Cl. ..... 271/258.01; 271/265.01

(58) Field of Classification Search ..... 271/258.01, 271/258.02, 259, 265.01, 265.02; 194/902; 235/382; 270/58.02, 58.03; 399/110
See application file for complete search history.

(56) References Cited

U.S. PATENT DOCUMENTS

| | | | | |
|---|---|---|---|---|
| 5,024,431 | A | 6/1991 | Shimizu et al. | |
| 5,678,123 | A | 10/1997 | Kim et al. | |
| 6,557,849 | B2 * | 5/2003 | Wyss | 271/259 |
| 6,749,053 | B2 * | 6/2004 | Ikuta | 194/206 |
| 7,017,902 | B2 * | 3/2006 | Kuru et al. | 271/258.02 |
| 2002/0092727 | A1 | 7/2002 | Kato | |
| 2003/0156298 | A1 | 8/2003 | Matsuyama et al. | |

FOREIGN PATENT DOCUMENTS

| | | |
|---|---|---|
| JP | 54021725 | 2/1979 |
| JP | 9-091494 | 4/1997 |

* cited by examiner

*Primary Examiner*—Patrick H Mackey
*Assistant Examiner*—Michael C McCullough
(74) *Attorney, Agent, or Firm*—Mattingly, Stanger, Malur & Brundidge, PC

(57) ABSTRACT

A sheet handling apparatus for handling a sheet therein, comprises, a first body including a first transfer path along which the sheet is driven to be moved, a second body including a second transfer path along which the sheet is driven to be moved, an interface area through which the first and second transfer paths of the first and second bodies movable with respect to each other on occasion demands, are capable of communicating with each other so that the sheet is capable of being transferred through the interface area between the first and second transfer paths when the first and second bodies have a predetermined positional relationship therebetween, and a controller for controlling at least one of the first and second transfer paths to drive the sheet to be moved along the at least one of the first and second transfer paths.

10 Claims, 8 Drawing Sheets

SHEET HANDLING MACHINE

The above-referenced patent application is a divisional application of U.S. Ser. No. 11/067,924, filed Mar. 1, 2005, which is hereby incorporated by reference into this application.

BACKGROUND OF THE INVENTION

The present invention relates to a sheet handling apparatus whose first and second bodies are movable with respect to each other on occasion demands. The sheet may be a paper money or a sheet to be transferred in a printer, a copy machine or the like.

In a prior art automatic teller machine as disclosed by JP-A-9-91494, when a clogging of a paper money occurs, the other paper moneys other than the paper money causing the clogging are removed and collected from a paper money transfer path.

BRIEF SUMMARY OF THE INVENTION

An object of the present invention is to provide a sheet handling apparatus for handling a sheet therein, wherein first and second bodies thereof are movable with respect to each other on occasion demands, and the sheet is restrained from being damaged between the first and second bodies or being discharged from a space between the first and second bodies.

A sheet handling apparatus for handling a sheet therein, comprises, a first body including a first transfer path along which the sheet is driven to be moved, a second body including a second transfer path along which the sheet is driven to be moved, an interface area through which the first and second transfer paths of the first and second bodies movable with respect to each other on occasion demands, are capable of communicating with each other so that the sheet is capable of being transferred through the interface area between the first and second transfer paths when the first and second bodies have a predetermined positional relationship therebetween, and a controller for controlling at least one of the first and second transfer paths to drive the sheet to be moved along the at least one of the first and second transfer paths.

If a sheet existence sensor is arranged to detect as to whether or not the sheet exists at the interface area, and the controller controls, in response to that the sheet existence sensor detects the existence of the sheet at the interface area and the controller receives a signal corresponding to a status other than the existence of the sheet at the interface area (for example, a demand or necessity of the relative movement between the first and second bodies), the at least one of the first and second transfer paths to drive the sheet to be moved along the at least one of the first and second transfer paths until the sheet is removed from the interface area to prevent the existence of the sheet at the interface area from being detected by the sheet existence sensor, the sheet is prevented from existing at the interface area when the first and second bodies are moved with respect to each other, so that the sheet is restrained from being damaged between the first and second bodies moved with respect to each other or being discharged from a space between the first and second bodies moved with respect to each other.

The status may includes at least one of a (detected) clogging of the sheet on at least one of the first transfer path, the second transfer path and the interface area, (When the sheet transfer path transfers the sheet by a predetermined distance, for example, a distance between the sheet detecting sensors, but, each or both of the sheet detecting sensor cannot detect a transit of the sheet, the clogging of the sheet is deemed to occur between the sheet detecting sensors.), at least one of probability and preliminary-notice of the relative movement between the first and second bodies (for example, an input of signal indicating a demand or necessity of maintenance work with the relative movement between the first and second bodies, caused by, for example, a (detected) clogging of the sheet on at least one of the first transfer path, the second transfer path and the interface area, a trouble in the apparatus, a periodic inspection of the apparatus, or the like), and at least one of probability and preliminary-notice of an operation stop of at least one of the first transfer path, the second transfer path, the sheet existence sensor and the controller (for example, an input of signal indicating a regular operation stop thereof, or a demand or necessity of maintenance work with the relative movement between the first and second bodies, caused by, the trouble or stop in operation of at least one of the first transfer path, the second transfer path, the sheet existence sensor and the controller).

If the operation of the at least one of the first transfer path, the second transfer path, the sheet existence sensor and the controller is allowed to be actually stopped, in response to that (or after) the sheet is removed from the interface area to prevent the existence of the sheet at the interface area from being detected by the sheet existence sensor, the sheet is securely removed from the interface area before first and second bodies are moved with respect to each other.

If the controller controls, in response to that the sheet existence sensor detects the existence of the sheet at the interface area and the controller receives the signal, the at least one of the first and second transfer paths to drive the sheet in such a manner that a velocity of the sheet along the at least one of the first and second transfer paths is increased and decreased frequently, the sheet can be transferred at a low average velocity along the at least one of the first and second transfer paths. If the controller controls, in response to that the sheet existence sensor detects the existence of the sheet at the interface area and the controller receives the signal, the at least one of the first and second transfer paths to drive the sheet in such a manner that the sheet is moved intermittently along the at least one of the first and second transfer paths, an excessive transfer of the sheet along the at least one of the first and second transfer paths is securely prevented.

If the controller controls, in response to that the sheet existence sensor detects the existence of the sheet at the interface area and the controller receives the signal, the at least one of the first and second transfer paths to prevent the sheet from being moved along the at least one of the first and second transfer paths and subsequently to drive the sheet to be moved along the at least one of the first and second transfer paths, an excessive transfer of the sheet after the sheet existence sensor detects the existence of the sheet at the interface area and the controller receives the signal is securely restrained.

If the controller controls, in response to that the sheet existence sensor detects the existence of the sheet at the interface area and the controller receives the signal, the at least one of the first and second transfer paths to drive the sheet to be moved at a first velocity (including zero) along the at least one of the first and second transfer paths and subsequently to drive the sheet to be moved at a second velocity higher than the first velocity along the at least one of the first and second transfer paths, an excessive transfer of the sheet after the sheet existence sensor detects the existence of the sheet at the interface area and the controller receives the signal is securely restrained.

If irrespective of whether or not the sheet is removed from the interface area, the controller prevents the at least one of the first and second transfer paths from driving the sheet to be moved along the at least one of the first and second transfer paths when at least one of a number of times of changes (such as decrease and/or increase) in velocity (or a number of times of intermittent movements or a number of intermittent repeats of movement) of the sheet along the at least one of the first and second transfer paths after the sheet existence sensor detects the existence of the sheet at the interface area and the controller receives the signal, a time period during which the sheet is moved after the sheet existence sensor detects the existence of the sheet at the interface area and the controller receives the signal, and a distance in which the sheet is moved after the sheet existence sensor detects the existence of the sheet at the interface area and the controller receives the signal, reaches a predetermined value, the transfer of the sheet after the sheet existence sensor detects the existence of the sheet at the interface area and the controller receives the signal is prevented from being continued everlastingly.

The sheet handling apparatus may further comprises another interface area through which the first and second transfer paths of the first and second bodies movable with respect to each other on occasion demands, are capable of communicating with each other so that the sheet is capable of being transferred through the another interface area between the first and second transfer paths when the first and second bodies have the predetermined positional relationship therebetween, and another sheet existence sensor arranged to detect as to whether or not the sheet exists at the another interface area, wherein the controller controls, in response to that at least one of the sheet existence sensor and the another sheet existence sensor detects the existence of the sheet at at least one of the interface area and the another interface area and the controller receives the signal, the at least one of the first and second transfer paths to drive the sheet to be moved along the at least one of the first and second transfer paths until the sheet is removed from each of the interface area and the another interface area to prevent the existence of the sheet at each of the interface area and the another interface area from being detected by corresponding one of the sheet existence sensor and the another sheet existence sensor.

If at least one of the first and second transfer paths has a main passage which is capable of receiving the sheet therein to be guided toward the interface area, an escape passage which is capable of receiving the sheet therein to prevent the sheet from being transferred toward the interface area, and a switch member movable with respect to the main passage and the escape passage between a first position for introducing the sheet into the main passage and a second position for introducing the sheet to the escape passage, and the switch member is positioned at the second position in response to that the controller receives a signal corresponding to a status of at least one of a clogging of the sheet on at least one of the first transfer path, the second transfer path and the interface area, at least one of probability and preliminary-notice of the relative movement between the first and second bodies, and at least one of probability and preliminary-notice of an operation stop of at least one of the first transfer path, the second transfer path, the sheet existence sensor and the controller, another sheet is prevented from being transferred to the main passage while the sheet is removed from the interface area. If the sheet handling apparatus further comprises a sheet existence sensor arranged to detect an existence of the sheet at a detecting position distant from the switch member at an upstream side with respect to the switch member in a traveling direction of the sheet along the at least one of the first and second transfer paths, wherein the switch member is prevented from being moved between the first and second positions when the sheet existence sensor detects the existence of the sheet, and the switch member is allowed to be moved between the first and second positions when the sheet existence sensor detects nonexistence of the sheet, the sheet is restrained from being damaged by the switch member.

If the sheet handling apparatus further comprises a sheet existence sensor arranged to detect as to whether or not the sheet exists at the interface area, wherein the controller outputs, in response to that the sheet existence sensor detects the existence of the sheet at the interface area and the controller receives a signal corresponding to a status other than the existence of the sheet at the interface area, an alert signal, an operator can become carefully when a maintenance work for the apparatus is performed. The status may include at least one of a clogging of the sheet on at least one of the first transfer path, the second transfer path and the interface area, at least one of probability and preliminary-notice of the relative movement between the first and second bodies, and at least one of probability and preliminary-notice of an operation stop of at least one of the first transfer path, the second transfer path, the sheet existence sensor and the controller.

The sheet existence sensor may detect the existence of the sheet at a single position of the interface area (between a first contact member of the first transfer path capable of contacting the sheet to drive the sheet so that the sheet is moved along the first transfer path and a second contact member of the second transfer path capable of contacting the sheet to drive the sheet so that the sheet is moved along the second transfer path in a traveling direction of the sheet between the first and second transfer paths while the first and second contact members are adjacent to each other in the traveling direction). The sheet existence sensor may detect (may includes two sheet existence sub-sensors to detect) the existence of the sheet at two (respective) positions of the interface area distant from each other in a traveling direction of the sheet along the at least one of the first and second transfer paths (between the first contact member of the first transfer path capable of contacting the sheet to drive the sheet so that the sheet is moved along the first transfer path and the second contact member of the second transfer path capable of contacting the sheet to drive the sheet so that the sheet is moved along the second transfer path in the traveling direction of the sheet between the first and second transfer paths while the first and second contact members are adjacent to each other in the traveling direction), so that nonexistence of the sheet at the interface area is detected when nonexistence of the sheet is detected at both of the two positions. One of the first and second bodies may include a discriminator for discriminating a kind of the sheet, and the other one of the first and second bodies may include a storage for storing the sheet. The sheet may be a paper money.

Other objects, features and advantages of the invention will become apparent from the following description of the embodiments of the invention taken in conjunction with the accompanying drawings.

DETAILED DESCRIPTION OF THE INVENTION

Hereafter, a paper money handling machine as an embodiment of the invention is explained.

Figure 1:
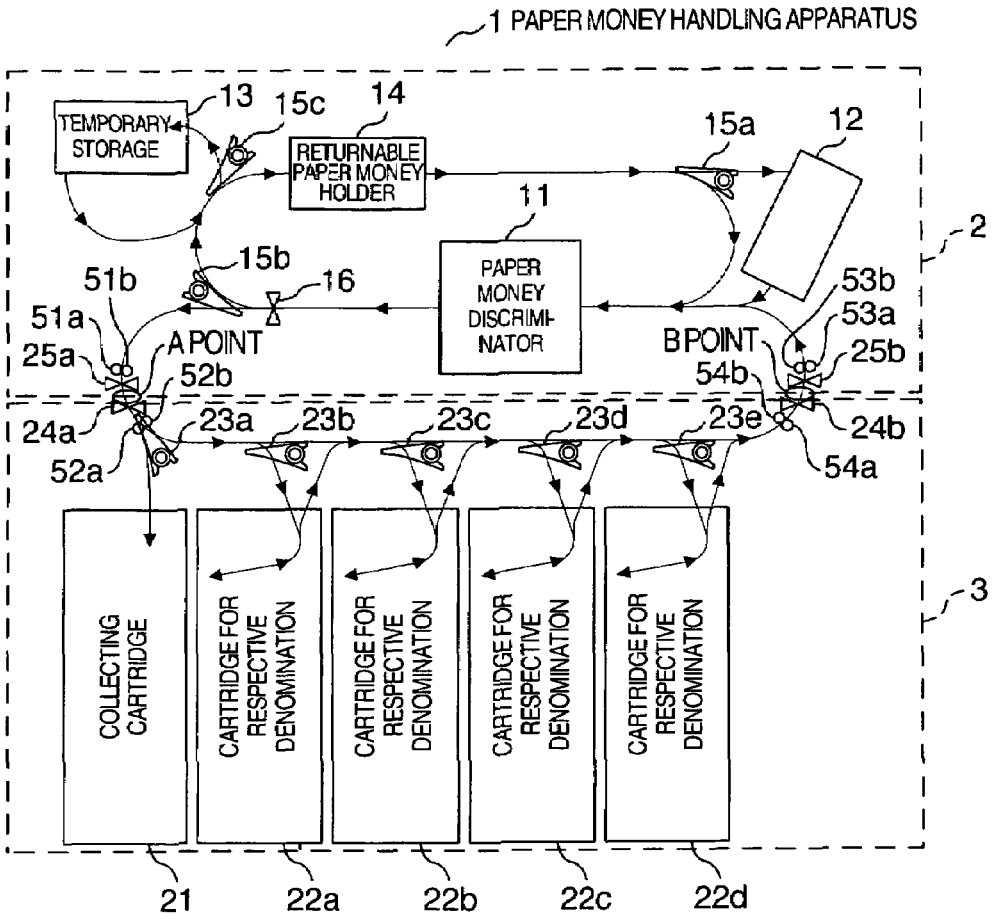
FIG. 1 is a schematic view showing a sheet handling apparatus as an embodiment of the invention.

FIG. 1 is a schematic cross sectional view showing a main structure of the paper money handling machine as an embodiment of the invention is explained. The paper money handling machine 1 as the embodiment includes an upper unit 2 (first unit) and a lower unit 3 (second unit) separable from each other. The upper unit 2 includes a paper money discriminator 11 for discriminating the paper money with respect to its falseness, kind and so forth, an input and output opening 12 through which a user inputs the paper money and the paper money is outputs to the user, a temporary storage 13 for temporarily storing the paper money discriminated by the paper money discriminator 11, and a returnable paper money holder 14 for temporarily holding a part (to be returned to the user) of the paper moneys which was input into the input and output opening 12 by the user and was not able to be discriminated with respect to its falseness, kind and so forth. The lower unit 3 includes a collector cartridge 21 for collecting the paper money which was failed to be received by the user, and cartridges 22 (22*a*-22*d*) of respective denominations for storing the paper moneys of respective denominations. For example, the cartridge 22*a* stores the paper moneys of 1000 yen, the cartridge 22*b* stores the paper moneys of 5000 yen, and the cartridges 22*c* and 22*d* store the paper moneys of 10000 yen.

Each of the upper unit 2 and the lower unit 3 includes respective paper money transfer paths for transferring the paper money as shown in the drawings. The paper money transfer paths are joined each other at A position (first joint portion) where the paper money is transferred from the upper unit 2 to the lower unit 3 and at B position (second joint portion) where the paper money is transferred from the lower unit 3 to the upper unit 2, when the upper unit 2 and the lower unit 3 are joined each other. Incidentally, although this embodiment has two of the A and B positions, the joint position may be single when the paper money can be transferred along the paper money transfer paths of the upper unit 2 and the lower unit 3 in either of directions opposite to each other, and the paper money transfer paths may have three joint portions in accordance with a structure of the paper money transfer paths.

The paper money transfer paths has a plurality of diverging points, and flappers for changing a course of the paper money to be transferred at the respective diverging points. As shown in the drawings, the flapper 15*a* changes the course of the paper money between a course toward the paper money discriminator 11 and a course toward the input and output opening 12, the flapper 15*b* changes the course of the paper money between a course toward the lower unit 3 and a course toward the temporary storage 13 or the returnable paper money holder 14, and the flapper 15*c* changes the course of the paper money between a course toward the temporary storage 13 and a course toward the returnable paper money holder 14. Further, flappers 23*a*-23*e* arranged on the lower unit 3 change the course of the paper money between a course toward the collector cartridge 21 or the cartridges 22 (22*a*-22*d*) of respective denominations and a course toward the upper unit 2. Further, another paper money transfer path for transferring the paper money from the cartridges 22 (22*a*-22*d*) of respective denominations to the upper unit 2 is arranged on the lower unit 3.

A paper money detecting sensor 16 is arranged to detect an existence of the paper money at an upstream position in a paper money transferring direction by a predetermined distance with respect to a diverging position of the flapper 15*b* on the paper money transfer path (a diverging point between a transfer path for transferring the paper money to the first joint portion and a transfer path for transferring the paper money to another portion in the first unit). A distance between the diverging position of the flapper 15*b* and a position where the sensor detects is determined in such a manner that a time period needed to transfer the paper money by the distance is shorter than a time period (for example, about 100 ms) needed for the flapper 15*b* to change the transfer path of the paper money. Further, the other paper money detecting sensors 24*a* and 24*b* are arranged on the A and B points respectively at which the paper money transfer paths of the upper unit 2 and the lower unit 3 are joined each other. Although the paper money detecting sensors 24*a* and 24*b* are arranged on the lower unit 3, they may be arranged on the upper unit 2. Pairs of the paper money detecting sensors 24*a* and 25*a* and the paper money detecting sensors 24*b* and 25*b* are arranged at the A and B points respectively so that the existence of the paper money at the A point is detected when both of the paper money detecting sensors 24*a* and 25*a* detect the paper money, and the existence of the paper money at the B point is detected when both of the paper money detecting sensors 24*b* and 25*b* detect the paper money. The paper money is clamped and driven to be transferred by a pair of friction roller 51*a* and 51*b* on the upper unit 2, by a pair of friction roller 52*a* and 52*b* on the lower unit 3, by a pair of friction roller 53*a* and 53*b* on the upper unit 2, and a pair of friction roller 54*a* and 54*b* on the lower unit 3. The paper money sensor 24*a* or the pair of the paper money detecting sensors 24*a* and 25*a* and the paper money sensor 24*b* or the pair of the paper money detecting sensors 24*b* and 25*b* are preferably arranged respectively between the pair of the friction roller 51*a* and 51*b* and the pair of the friction roller 52*a* and 52*b*, and between the pair of the friction roller 53*a* and 53*b* and the pair of the friction roller 54*a* and 54*b*.

Incidentally, additional paper money detecting sensors on the paper money transfer path other than the paper money detecting sensors shown in FIG. 1 may be arranged on the paper money transfer path so that a position where the paper money is stopped is detected when the clogging of the paper money occurs.

Figure 2:
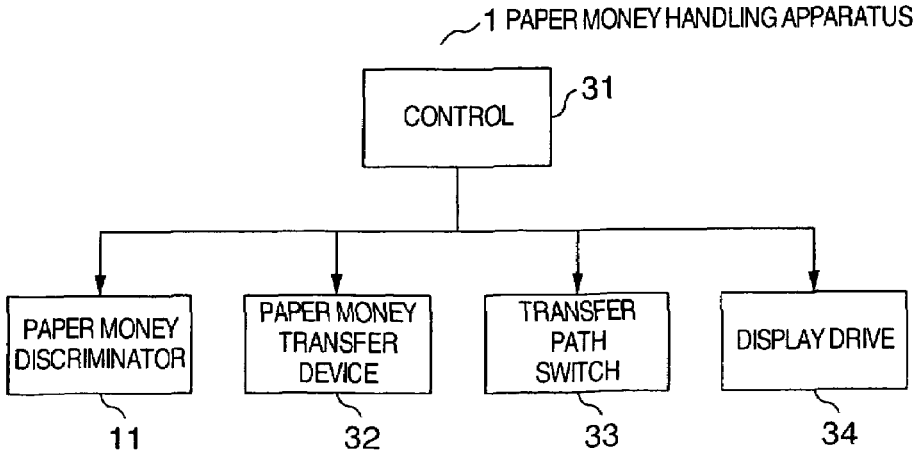
FIG. 2 is a schematic view showing main components of the sheet handling apparatus.

FIG. 2 is a block diagram showing main components functions of the paper money handling apparatus as the embodiment of the invention. The paper money handling apparatus 1 includes a controller 31 for controlling an operation of the bodies, a paper money transfer part 32 for transferring and stopping the paper money on the paper money transfer path, a transfer path switching part 33 for controlling changes of the flappers 15*a*-14*c* and 23*a*-23*e*, a display operation part 34 for indicating a status of the apparatus bodies and inputting instruction, and a paper money discrimination part 11. Further, the paper money handling apparatus 1 includes a medium treatment part and so forth as publicly known paper money handling machines for receiving a medium such as a card, bank note or the like, but it not shown in the drawing and not explained in detail.

The paper money transfer part 32 drives and stops a transfer motor for driving the paper money along the paper money transfer path. The transfer path switching part 33 operates the flappers 15*a*-15*c* and 23*a*-23*e* on the paper path transfer path in accordance with an instruction from the controller 31. The controller 31 instructs the drive and stop of the paper money transfer path 32 and the switching of the flappers 15*a*-15*c* and 23*a*-23*e* through the transfer path switching part 33, on the basis of the input operation received on the display operation part 34 and the paper money detection results at the paper money detecting sensors 16, 24 and 24*b*.

Here, a route of the paper money on receiving the paper money and discharging the paper money is explained briefly. At first, the route of the paper money on receiving the paper money is explained. The user puts the paper money into the input and output opening 12. The paper money handling apparatus 1 moves the paper money out of the input and output opening 12 one by one to be transferred to the paper money discrimination part 11. The paper money discrimination part 11 discriminates the paper money regarding its falseness and kind of denomination thereof. The paper money is transferred to the temporary storage 13 and/or the returnable paper money holder 14 other than the lower unit 3 after being discriminated. The paper money which was deemed to be not false and whose kind of denomination is read out by the paper money discrimination part 11 is held by the temporary storage 13, and the paper money which was deemed to be false or whose kind of denomination cannot be read out by the paper money discrimination part 11 is held by the returnable paper money holder 14. To which the paper money is transferred is determined by switching the flappers 15*b* and 15*c*.

After the paper money discrimination part 11 discriminates all of the paper moneys taken into the input and output opening 12, the paper money handling apparatus 1 takes out the paper money from the returnable paper money holder 14 to be transferred to the input and output opening 12 by one sheet by one sheet. After all of the paper moneys held by the returnable paper money holder 14 are transferred to the input and output opening 12, the flapper 15*a* is switched and the paper money held by the temporary storage 13 is taken out therefrom by one sheet by one sheet to be transferred to the paper money discrimination part 11 so that the paper money is discriminated again regarding its falseness and its kind of denomination to be confirmed. The paper money handling apparatus 1 transfers the paper money again discriminated by the paper money discrimination part 11 toward the A point other than the temporary storage 13 and the returnable paper money holder 14. This change as to which the paper money is transferred to is performed by switching the flapper 15*b*. The paper money handling apparatus 1 transfers each of the paper moneys to corresponding one of the cartridges 22*a*-22*d* of respective denominations in accordance with its confirmed kind of denomination, and the paper money which was deemed to be false or whose kind of denomination cannot be read out by the paper money discrimination part 11 is transferred to the collector cartridge 21. At this situation, the paper money transfer apparatus 1 controls the flappers 23-23*e* in accordance with each of the paper moneys transferred to the lower unit 3 to be transferred to and received by the corresponding one of the cartridges 21 and 22*a*-22*d*.

Next, the paper money transfer path for discharging the paper money is explained. An amount of the money to be discharged is input by the user through the display operation part 34. The paper money handling apparatus 1 determines a number of the paper moneys for each of kinds of denominations to be discharged on the basis of the input amount of the money. The paper money handling apparatus 1 takes out the number of the paper moneys by one sheet by one sheet on the basis of the determined number of the paper moneys for each of kinds of denominations from the cartridges 22*a*-22*d* of respective denominations. The paper money taken out of the cartridges 22*a*-22*d* of respective denominations are transferred to the paper money discrimination part 11 on the upper unit 2 through the B point. The paper money discrimination part 11 discriminates each of the paper money regarding its falseness and kind of denomination. The transfer path switching part 33 controls the flappers 15*b* and 15*c* to transfer to the temporary storage 13 the paper money which was deemed to be not false and whose kind of denomination is read out by the paper money discrimination part 11, and to the collector cartridge 21 the paper money which was deemed to be false and whose kind of denomination cannot be read out by the paper money discrimination part 11. After the temporary storage 13 stores the amount of the paper moneys to be discharged, the paper money handling apparatus 1 takes out the paper moneys from the temporary storage 13 by one sheet by one sheet to be transferred to the input and output opening 12. The user takes out the paper moneys from the input and output opening 12.

Incidentally, the paper money handling apparatus 1 takes out from the input and output opening 12 the paper money which was failed to be received by the user, and transfers it along the paper money transfer path to the collector cartridge 21.

Figure 3:
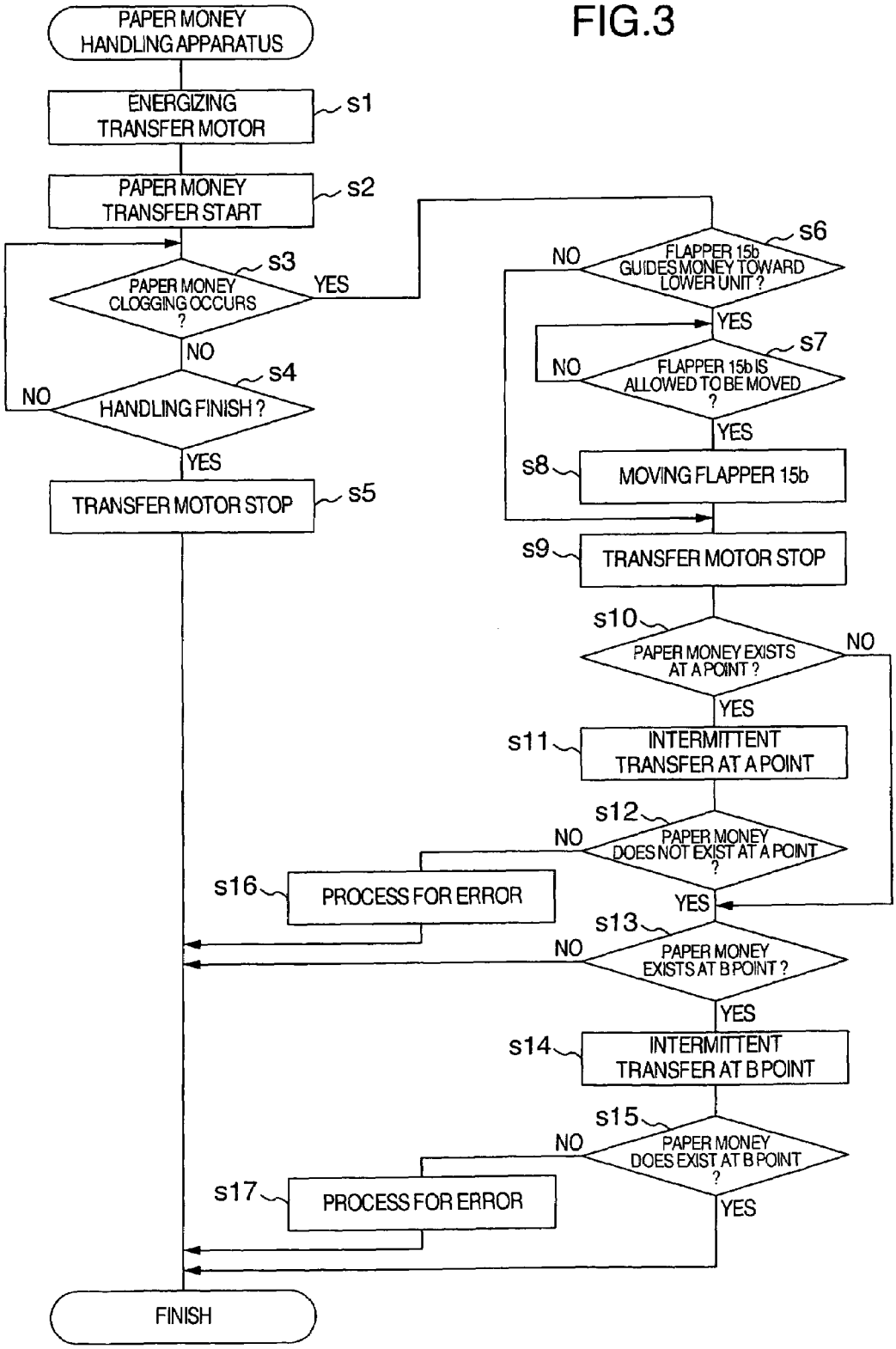
FIG. 3 is a flow chart for controlling a transfer of a sheet according to one aspect of the invention.

Next, the drive control on the paper money transfer path for receiving the money and discharging the money or the like as described above in the paper money handling apparatus 1 of the embodiment is described. FIG. 3 is a flow chart showing the drive control on the paper money transfer path in the paper money handling apparatus 1 of the embodiment.

When the paper money is transferred along the paper money transfer path to be received or discharged, in the paper money handling apparatus 1, the paper money transfer part 32 drives the not shown transfer motor for driving the paper money transfer path (s1), and the paper moneys to be received or discharged is taken out from the input and output opening 12 or the cartridges 22*a*-22*d* of respective denominations by one sheet by one sheet to start the transfer of the taken out paper moneys along the paper money path (s2). As described above, the route for transferring the paper money is changed between receiving the money and discharging the money.

The paper money handling apparatus 1 monitors the paper money regarding a clogging or jam thereof on the paper money transfer path until all of the paper money which start to be transferred are transferred completely (s3, s4), The clogging of the paper money on the paper money transfer path is detected by the paper money detecting sensors arranged on a plurality of respective positions on the paper money transfer path. (That is, when the paper money transfer path transfers the paper money by a predetermined distance, for example, a distance between the paper money detecting sensors, but, the paper money detecting sensor cannot detect a transit of the paper money, the clogging of the paper money is deemed to occur.) The paper money handling apparatus 1 stops the transfer motor 1 energized by the s1 at s5 when it decides that the clogging of the paper money on the paper money transfer path does not occur and the transfer of the paper money is finished at s4 (step 4), and the handling is finished.

Figure 4A:
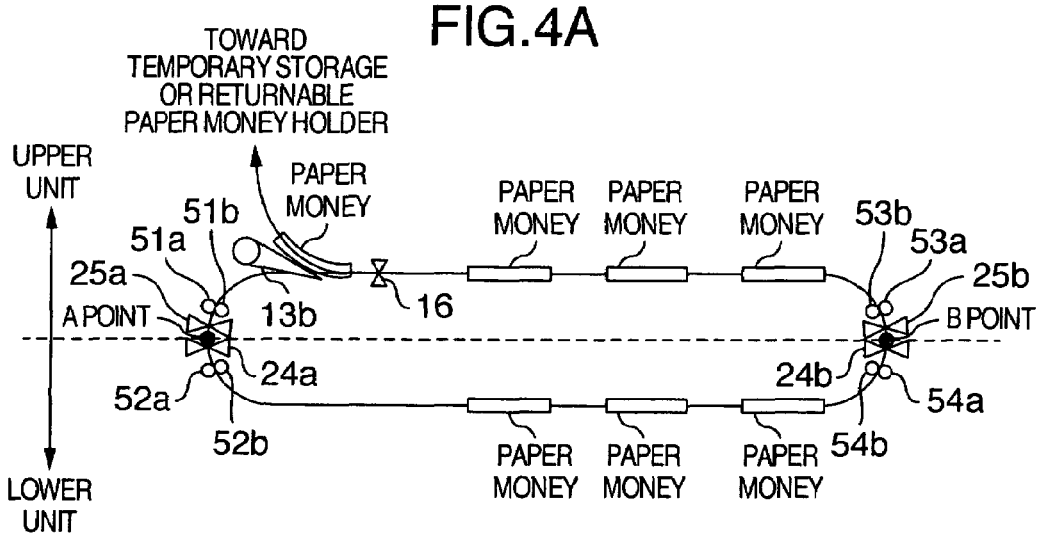
FIG. 4A is a schematic view showing a position of a flapper 15*b* for preventing the sheet from being transferred toward A point.
Figure 4B:
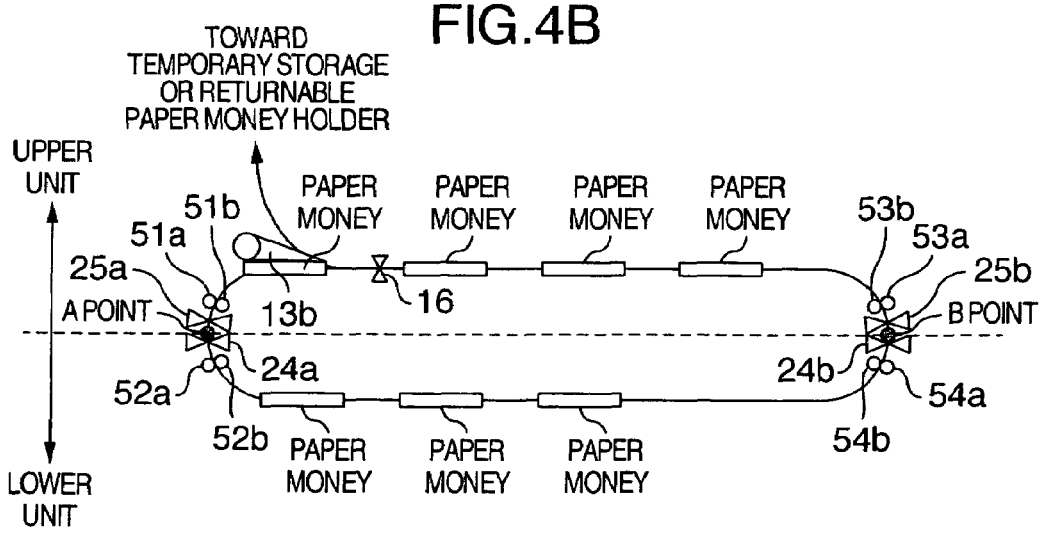
FIG. 4B is a schematic view showing another position of the flapper 15*b* for transferring the sheet toward A point.

On the other hand, when the paper money handling apparatus 1 decides that the clogging of the paper money on the paper money transfer path occurs at s3, the paper money handling apparatus 1 monitors an orientation of the flapper 15*b* as to which it is directed, for transferring the paper money toward the temporary storage 13 or the returnable paper money holder 14 (as shown in FIG. 4*a*), or for transferring the paper money to the A point as the joint portion for lower unit 3 (as shown in FIG. 4*b*). When the paper money handling apparatus 1 decides at s6 that the flapper 15*b* is directed for transferring the paper money toward the temporary storage 13 or the returnable paper money holder 14, the paper money handling apparatus 1 proceeds to s9 at which the transfer motor for driving the paper money path (or the pair of friction roller 51*a* and 51*b* on the upper unit 2, the pair of friction roller 52*a* and 52*b*, the pair of friction roller 53*a* and 53*b* and the pair of friction roller 54*a* and 54*b*) is stopped without passing s7 and s8. When the paper money handling apparatus 1 decides at s6 that the flapper 15*b* is directed for transferring the paper money to the A point as the joint portion for lower unit 3, the paper money handling apparatus 1 proceeds to s7 and s8 to switch the flapper 15*b* to be directed for transferring the paper money toward the temporary storage 13 or the returnable paper money holder 14.

Figure 5A:
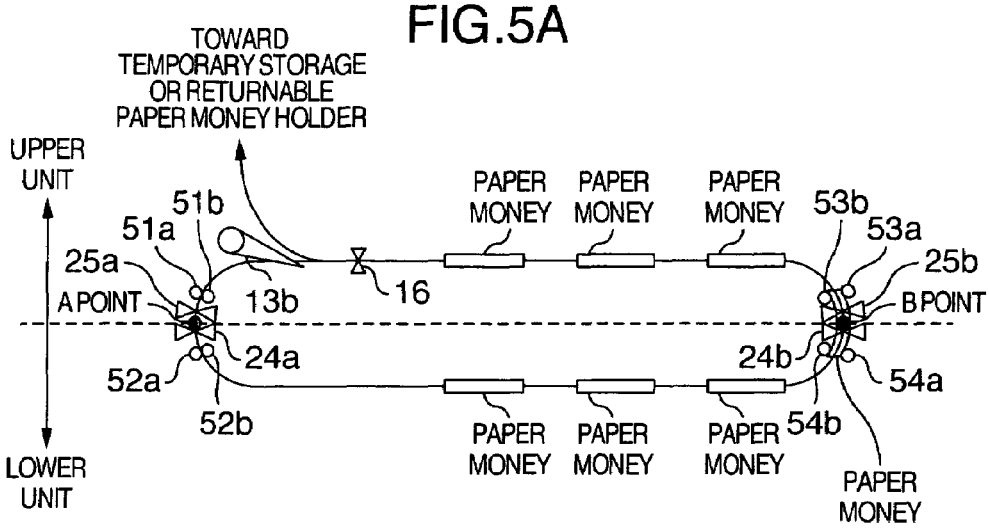
FIG. 5A is a schematic view showing a position of the sheet detected by a sensor 16 when the flapper 15*b* is allowed to be moved.
Figure 5B:
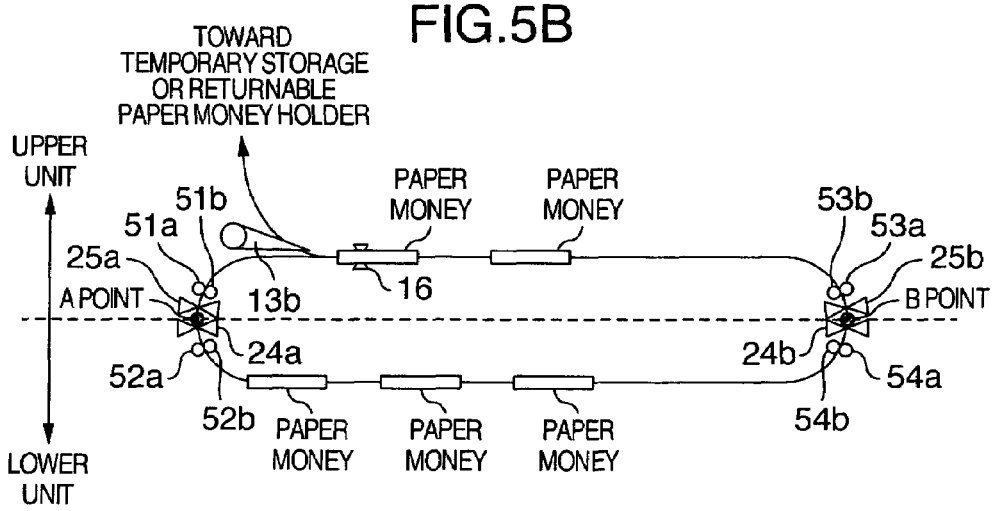
FIG. 5B is a schematic view showing another position of the sheet detected by the sensor 16 when the flapper 15*b* is prevented from being moved.

The operations at s7 and s8 are explained with making reference to FIG. 5. The paper money handling apparatus 1 decides at s7 as to whether or not the flapper 15*b* can be switched. Concretely, when in the situation as shown in FIG. 5A, the paper money detecting sensor 16 does not detect the paper money arranged at the upstream side by the predetermined distance with respect to the diverging point on the paper money transfer path formed by the flapper 15*b* (that is, a position of a front end of the flapper 15 along the paper money transfer path), the paper money handling apparatus 1 decides that the flapper 15*b* can be switched. On the contrary, as shown in situation as shown in FIG. 5B, when the paper money detecting sensor 16 detects the paper money, the paper money handling apparatus 1 decides that the flapper 15*b* cannot be switched.

When the paper money handling apparatus 1 decides at s7 that the flapper 15*b* cannot be switched, the paper money handling apparatus 1 continues to prevent the switching from being switched. In this time, since the transfer motor continues to drive the paper money transfer path, the paper money continues to be transferred along the paper money transfer path. Subsequently, when the situation as shown in FIG. 5A is obtained and the paper money handling apparatus 1 decides that the flapper 15*b* can be switched, the flapper 15*b* is switched at s8 to be directed for transferring the paper money toward the temporary storage 13 or the returnable paper money holder 14.

As described above, the distance between the diverging point on the paper money transfer path at which the route is changed by the flapper 15*b* and the paper money detecting sensor 16 is shorter than the distance in which the paper money is transferred within the time period from a start in switching of the flapper 15*b* to an end in switching thereof. Therefore, if the switching of the flapper 15*b* is started when the paper money detecting sensor 15 does not detect the paper money, the paper money is prevented from existing at the diverging point until the switching of the flapper 15*b* is finished. In other words, the paper money handling apparatus 1 finds at s7 a timing from which the switching of the flapper 15*b* is started in such a manner that the paper money is prevented from existing at the diverging point until the switching of the flapper 15*b* is finished. By switching the flapper 15*b* at this timing, the transferred paper money is prevented from being clamped by the switched flapper 15*b* and a clogging of the paper money is prevented from occurring at the diverging point.

The paper money handling apparatus 1 switches the flapper 15*b* at s8, and the transfer motor for driving the paper money transfer path is stopped at s9.

Next, the paper money handling apparatus 1 decides as to whether or not the paper money exists at the A point where the paper money transfer paths of the upper unit 2 and the lower unit 3 are joined each other (s10). The paper money existing at the A point extends between the upper unit 2 and the lower unit 3. In other words, whether or not the paper money extends between the upper unit 2 and the lower unit 3 at the A point is detected at s10. If the paper money handling apparatus 1 decides that the paper money exists at the A point, an intermittent transfer process A is performed (s11).

Figure 6:
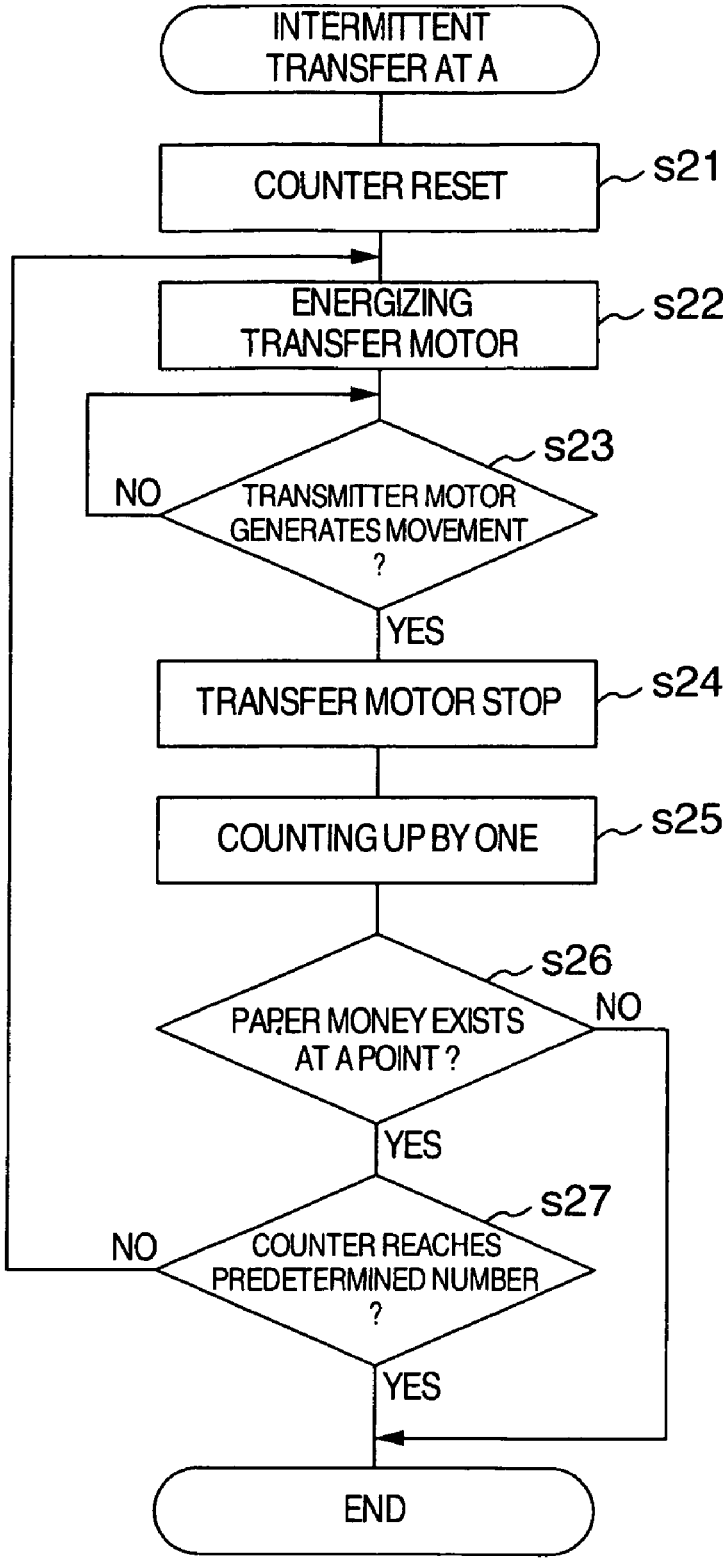
FIG. 6 is a flow chart for controlling the transfer of the sheet when the sheet exists at A point.

FIG. 6 is a flow chart showing the intermittent transfer process A. The paper money handling apparatus 1 resets a counter for counting a number of repeated cycles (s21). The paper money transfer path 1 energizes the transfer motor for paper money transfer path (s22), and stops the transfer motor (s24) just after a movement of the transfer motor is detected (s23). By each of repeated cycles of s22-s24, the paper money on the paper money transfer path proceeds by a small length, for example, 1-2 cm at each cycle.

The paper money handling apparatus 1 increases a counted number of the counter reset at s21 by one (s25). Subsequently, whether or not the paper money exists at the A point is decided (s26), and this process is finished if the paper money does not exist. On the other hand, if it is decided at s26 that paper money exists at the A point, whether or not the counted number of the counter reaches a predetermined number is decided, the control is returned to s22 to repeat the above cycle when the counted number does not reach the predetermined number. On the contrary this process is finished when it is decided at s27 that the counted number reaches the predetermined number.

Figure 7:
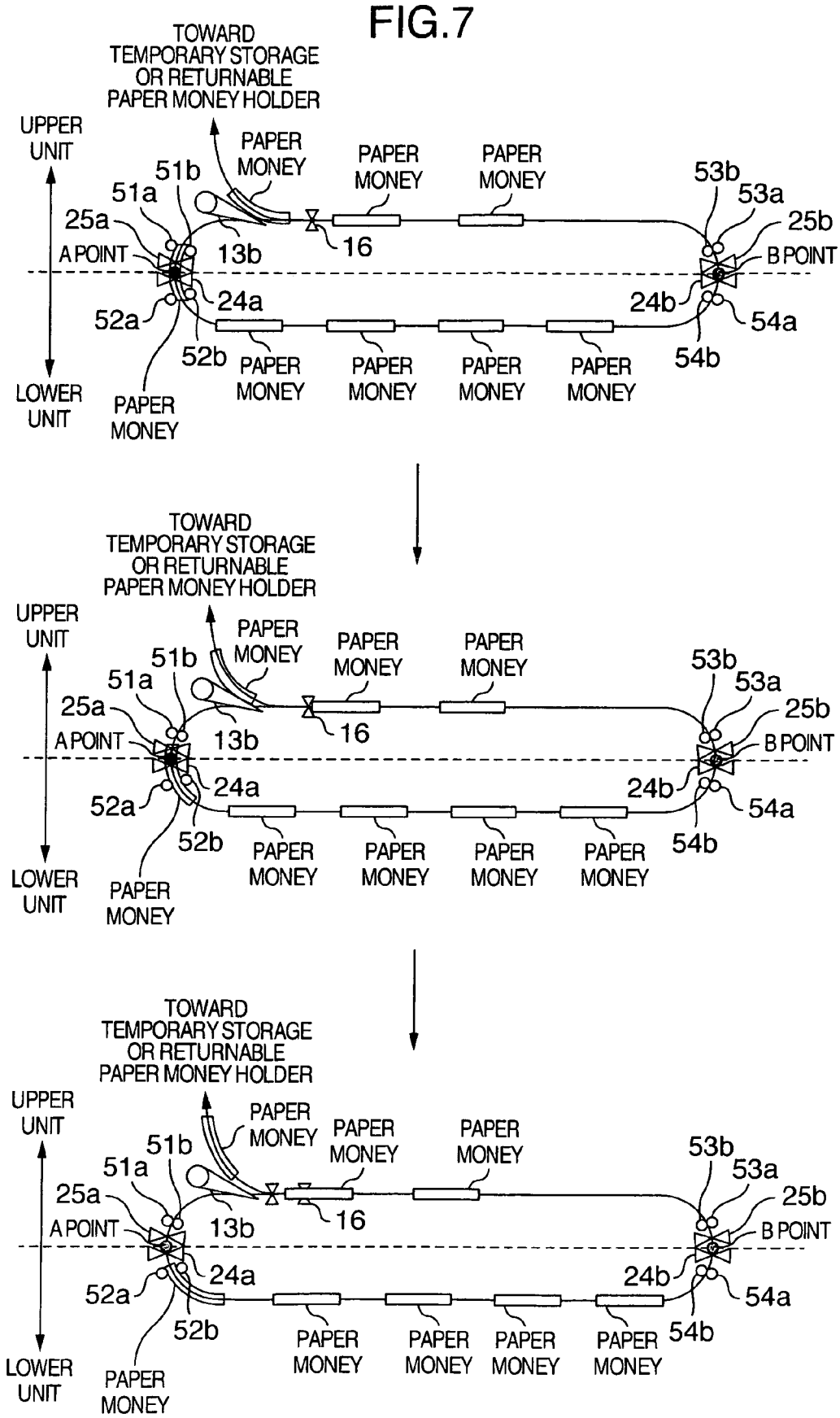
FIG. 7 includes schematic views showing a proceeding of the transfer of the sheet when the sheet exists at A point.

The above intermittent transfer process is brought about when the paper money exists at the A point as shown in uppermost portion of FIG. 7. In this situation, the flapper 15*b* is directed for transferring the paper money toward the temporary storage 13 or the returnable paper money holder 14. Therefore, by repeating the cycle s22-s24 in the paper money handling apparatus 1, the paper money existing between the diverging point as the flapper 15*b* and the A position proceeds by small distance at each cycle so that the paper money is prevented from existing at the A point (as shown in middle and lowermost portions of FIG. 7). Further, another paper money is prevented from being fed to the A point.

Incidentally, if the clogging of the paper money occurs in the vicinity of the A point, the paper money is sometimes prevented from being removed from the A point irrespective of repeating the cycle s22-s24, and this process is finished when it is decided that the counted number of the counted reaches the predetermined number after repeating the cycle s22-s24. Therefore, the cycle s22-s24 is prevented from being continued everlastingly.

Figure 8:
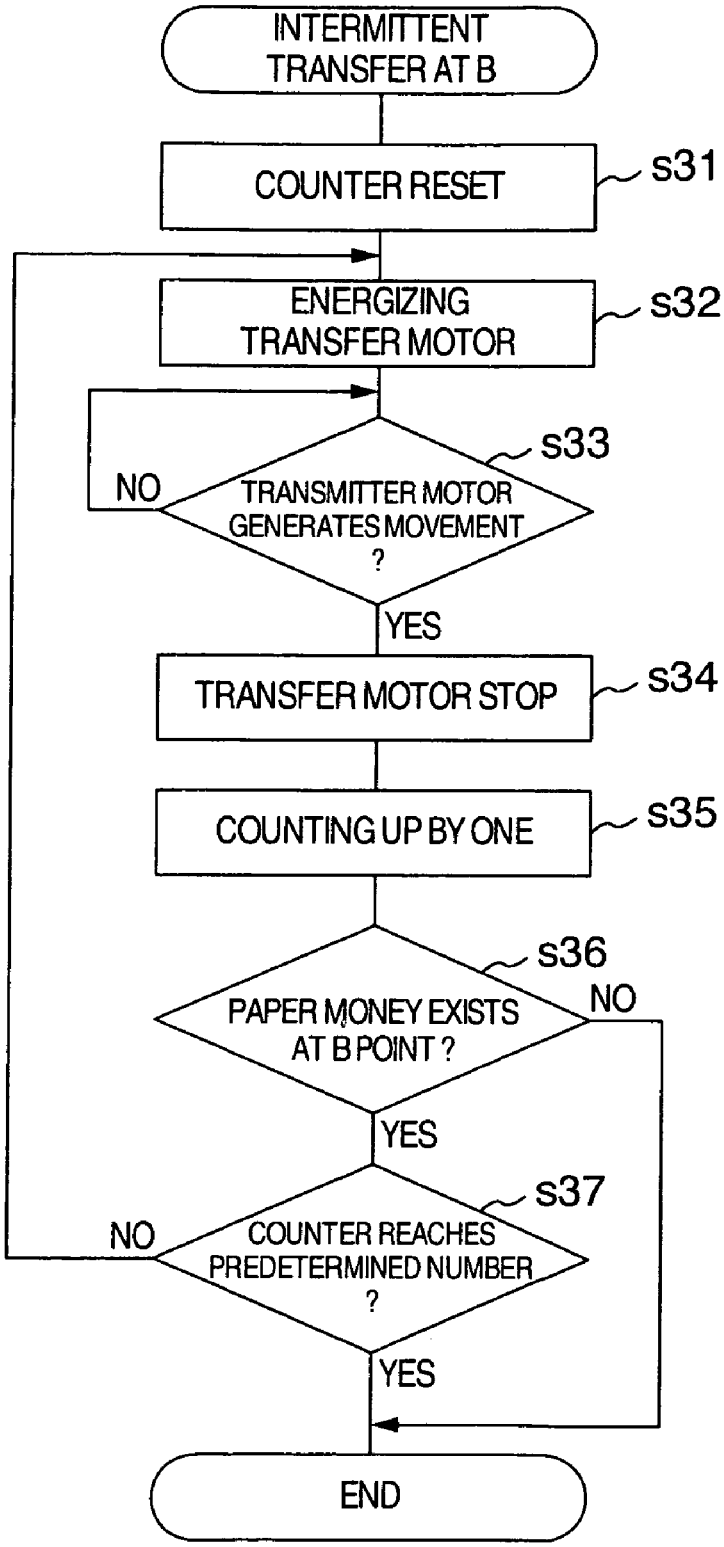
FIG. 8 is a flow chart for controlling the transfer of the sheet when the sheet exists at B point.

After finishing the intermittent transfer process of s11, the paper money handling apparatus 1 decides as to whether or not the paper money exists at the A point (s12). If it is decided at s12 that the paper money does not exist at the A point, the paper money handling apparatus 1 decided as to whether or not the paper money exists at the B point as the joint portion between the paper money transfer paths of the upper unit 2 and the lower unit 3*b* (s13). At s13, the paper money detecting sensor 24*b* decides as to whether or not the paper money is detected. The paper money existing at the B point extends between the upper unit 2 and the lower unit 3*b*. In other words, at s13, it is decided as to whether or not the paper money extends between the upper unit 2 and the lower unit 3*b*. If the paper money handling apparatus 1 decides at s13 that the paper money exists at the B point, the paper money handling apparatus 1 performs an intermittent transfer process B as shown in FIG. 8 (s18).

The paper money handling apparatus 1 performs an error treatment for indicating on the display operation part 34 a message of that the paper money exists at the A point to be known by the operator, when it is decided at s12 that the paper money is not removed from the A point (s16). Therefore, since the operator can recognize that the paper money exists at the joint portion between the upper unit 2 and the lower unit 3*b* before separating the upper unit 2 and the lower unit 3*b* from each other, the separating operation can be performed carefully.

Figure 9:
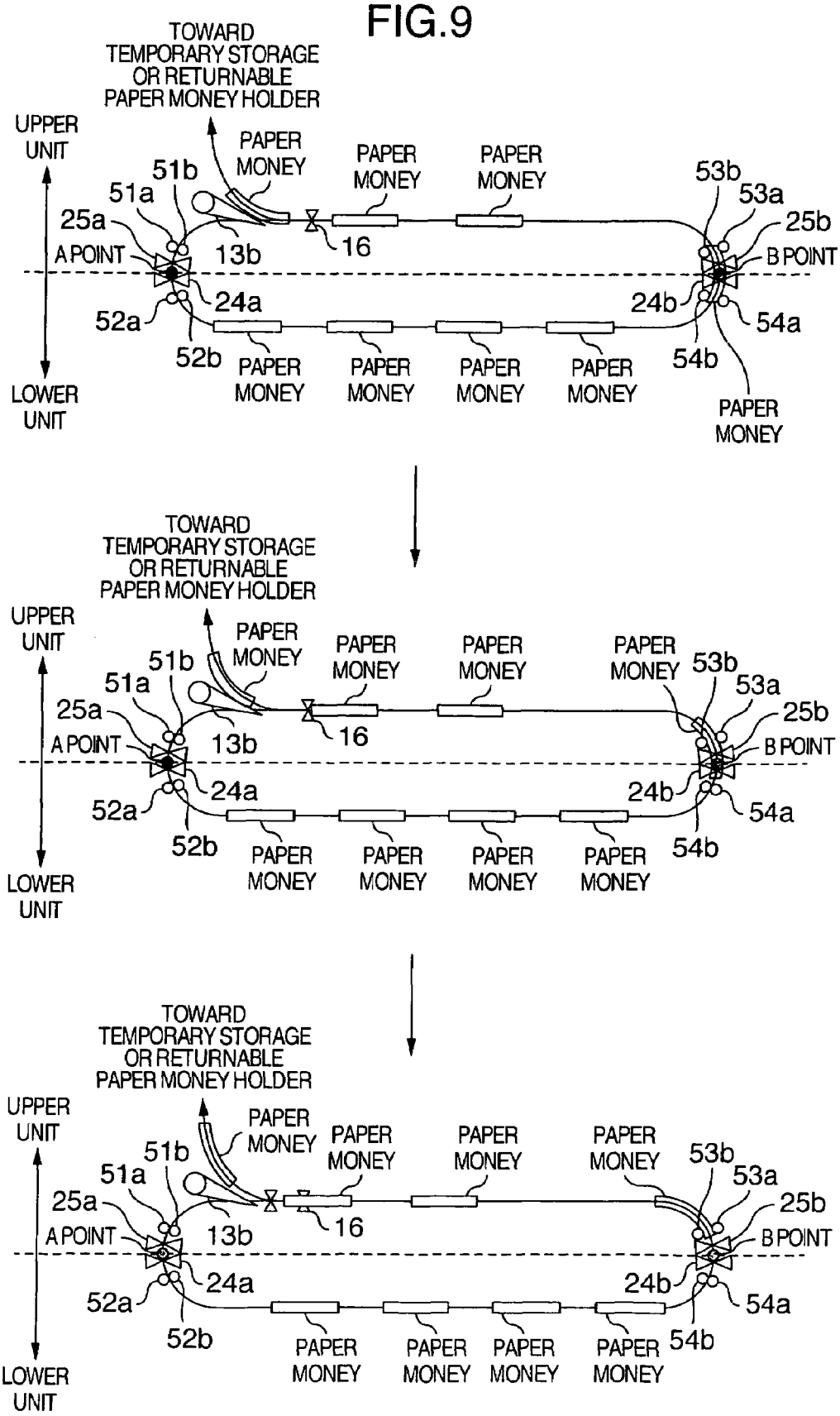
FIG. 9 includes schematic views showing a proceeding of the transfer of the sheet when the sheet exists at B point.

The intermittent transfer process B at s 14 is similar to the process shown in FIG. 6, but is differentiated from the process shown in FIG. 6 in that it is decided at s36 whether or not the paper money exists at the B point. The intermittent transfer process at s14 is brought about when the paper money exists at the B point as shown in an uppermost portion of FIG. 9. In this situation, the flapper 15*b* is directed for transferring paper toward the temporary storage 13 or the returnable paper money holder 14. By repeating a cycle s32-s34 in the paper money handling apparatus 1, the paper money between the diverging point formed by the flapper 15*b* and the A point proceeds by small length at each cycle, so that the paper money is removed from the B point (make reference to middle and lowermost portions of FIG. 9). Further, since the flapper 15*b* is directed for transferring paper toward the temporary storage 13 or the returnable paper money holder 14 when the intermittent transfer process is brought about at s14, the paper money is prevented from existing at the A point when the intermittent transfer process at s14 is finished.

The paper money handling apparatus 1 brings about the intermittent transfer process at s14, and it is decided as to whether or not the paper money is removed from the B point (a15). If it is decided at s15 that the paper money is not removed from the B point, an error treatment in which the display operation part 34 shows a message of that the paper money exists at the B point to be known by the operator is performed (s17).

As described above, since the paper money handling apparatus 1 of the embodiment performs the process shown in FIG. 3 when the clogging of the paper money occurs on the paper money transfer path, the paper money is prevented from extending between the upper unit 2 and the lower unit 3. Therefore, when the upper unit 2 and the lower unit 3 are separated from each other by the operator to treat the clogging of the paper money, the paper money is prevented from being broken and dropping out of the apparatus, so that a trouble in repair work for the clogging of the paper money in the bodies of the apparatus can be decreased. Further, since the bypass transfer path usually not used as the paper money transfer path as disclosed by the prior document is not needed, a structure of the bodies of the apparatus is simplified and an increase in cost thereof is prevented.

Further, when the paper money is not removed from the A point and the B point by the intermittent transfer processes A and B shown in FIGS. 6 and 8, such result is shown on the display operation part 34, so that an attention is drawn to the operator separating the upper unit 2 and the lower unit 3 from each other, and a careful operation is performed.

In the embodiment, a first unit including a paper money discriminator part for discriminating the paper money regarding its kind of denomination and a second unit including a paper money storage part for storing the paper money are separable from each other, and first and second paper money transfer paths of the first and second units are joined each other through a first joint portion through which the paper money is transferred from the first unit to the second unit when the first and second units are joined each other. Paper money transfer means transfers the paper money along the combined paper money transfer paths so that the paper money is transferred between the first and second units. Further, when jam detecting means detects an occurrence of clogging of the paper money, that is, jam on the paper money transfer path, the paper money transfer means stops the transfer of the paper money. In this situation, if paper money detecting means detects the paper money at least one of the vicinity of the first joint portion and the vicinity of the second joint portion, the paper money transfer means repeats intermittently a transfer of the paper money until the paper money is prevented from being detected at two of the joint portions. An operation of transferring the paper money by, for example, some centimeter (2-3 cm) and stopping is repeated.

Therefore, when the clogging of the paper money occurs on the paper money transfer path, the bodies of the apparatus can be stopped with preventing the paper money from existing at the joint portions between the units. Therefore, when the units are separated from each other and the operator removes the paper money from the paper money transfer path to remove the trouble of the clogging of the paper money, the paper money is prevented from being broken by tensile and dropping out of the apparatus. Further, since a bypass transfer path not used usually des not need to be arranged on the paper money transfer path, the structure of the bodies of the apparatus is prevented from being complicated.

Forwarding course switching means for selectively switching a course to which the paper money is transferred is arranged along the first paper money transfer path on a diverging point at which a transfer path for transferring the paper money to the first joint portion and a transfer path for transferring the paper money to another portion in the first unit diverge from each other, and since the forwarding course switching means selects the transfer path for transferring the paper money to the another portion other than the first joint portion when the jam detecting means detects the clogging of the paper money on the paper money transfer path, the forwarding course switching means switches at the diverging point the course to which the paper money is transferred in such a manner that the paper money existing on the first paper money transfer path is transferred to the another portion other than the first joint portion when the clogging of the paper money occurs on the paper money transfer path. Therefore, when the transfer of the paper money is repeated intermittently, the money existing on the first paper money transfer path is prevented from being transferred in turn to the first joint portion so that a number of intermittent repeats of the transfer of the paper money is decreased.

Further, if the paper money detecting means detects the existence of the paper money at an upstream position distant from the diverging point by a predetermined distance in a transfer direction, and the forwarding course switching means selects the transfer path for transferring the paper money to the first joint portion when the jam detecting means detects the clogging of the paper money on the paper money transfer path, the forwarding course switching means switches the course to which the paper money is transferred from the transfer path for transferring the paper money to the first joint portion to the transfer path for transferring the paper money to the another portion other than the first joint portion after the paper money detecting means does not detect the existence of the paper money at the upstream position distant from the diverging point by the predetermined distance in the transfer direction. In this structure, if the paper money exists at the upstream position distant from the diverging point by the predetermined distance in the transfer direction when the clogging of the paper money occurs on the paper money transfer path, the course to which the paper money is transferred is switched at the diverging point from the transfer path for transferring the paper money to the first joint portion to the transfer path for transferring the paper money to the another portion other than the first joint portion after the paper money detecting means does not detect the existence of the paper money at the upstream position distant from the diverging point by the predetermined distance in the transfer direction. Therefore, the course to which the paper money is transferred is switched at the diverging point when the paper money does not exists at the diverging point, so that another clogging of the paper money is prevented from occurring at the diverging point when switching.

Incidentally, the predetermined distance is shorter than a distance by which the paper money proceeds within a time period needed for switching at the diverging point the course to which the paper money is transferred, for example, 10-20 ms.

Further, the paper money transfer means stops the intermittent transfer of the paper money in response to that the number of intermittent repeats of the transfer of the paper money reaches a predetermined number when the paper money detecting means detects the existence of the paper money at least one of the vicinity of the first joint portion and the vicinity of the second joint portion. In this structure, the intermittent repeats of the transfer of the paper money is prevented from being continued everlastingly when the clogging of the paper money occurs.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper money handling apparatus comprising:

a first unit including an access port through which a paper money is taken into the apparatus from a user and is supplied from the apparatus to the user, a paper money discriminator for discriminating a kind of the paper money, and a first paper money passage through which the paper money is transferred in the first unit, a second unit being movable with respect to the first unit and including a paper money container for containing the paper money and a second paper money passage through which the paper money is transferred in the second unit, a third paper money passage through which the paper money is transferred between the first paper money passage and the second paper money passage;

a paper money detector for detecting an existence of the paper money in the third paper money passage, a clogging detector for detecting a clogging of the paper money in the apparatus, and a controller for controlling the first, second and third paper money passages to transfer the paper money therealong, wherein the controller stops a paper money transferring operation of the first, second and third paper money passages in response to that the clogging detector detects the clogging of the paper money, and subsequently restarts the paper money transferring operation in response to that the paper money detector detects the existence of the paper money, and continues the paper money transferring operation until the existence of the sheet at the third paper money passage is prevented from being detected by the paper money detector.

2. The paper money handling apparatus according to claim 1, wherein the first paper money passage includes a transferring course switch for guiding the paper money to the third paper money passage, and the controller controls the transferring course switch to prevent the paper money from being transferred to the third paper money passage in response to that the clogging detector detects the clogging of the paper money and subsequently controls the first, second and third paper money passages to stop the paper money transferring operation.

3. The paper money handling apparatus according to claim 2, wherein the first paper money passage includes a switch point paper money detector for detecting the existence of the paper money at a position before, by a predetermined distance, from the transferring course switch, and the controller controls the transferring course switch to prevent the paper money from being guided to the third paper money passage in response to that the clogging detector detects the clogging of the paper money and the paper money is prevented from being detected at the position and subsequently controls the first, second and third paper money passages to stop the paper money transferring operation.

4. The paper money handling apparatus according to claim 1, wherein the controller controls the first, second and third paper money passages to transfer the paper money intermittently after restarting the paper money transferring operation.

5. The paper money handling apparatus according to claim 4, wherein the controller controls the first, second and third paper money passages to prevent the intermittent paper money transferring operation in response to a number of times of the intermittent paper money transfers reaches a predetermined number when the switch point paper money detector detects the existence of the paper money.

6. The paper money handling apparatus according to claim 1, wherein the third paper money passage includes a fourth paper money passage for transferring the paper money from the first paper money passage to the second paper money passage, and a fifth paper money passage for transferring the paper money from the second paper money passage to the first paper money passage, the paper money detector for detecting the existence of the paper money in each of the fourth and fifth paper money passages, and the controller restarts the paper money transferring operation in response to that the paper money detector detects the existence of the paper money in at least one of the fourth and fifth paper money passages after stopping the paper money transferring operation, and continues the paper money transferring operation until the existence of the sheet at the third paper money passage is prevented from being detected by the paper money detector.

7. The paper money handling apparatus according to claim 6, wherein the first paper money passage includes a temporary container for containing the paper money after being discriminated by the discriminator, and a transferring course switch arranged between the temporary container and the discriminator to guide the paper money to the fourth paper money passage, and the controller controls the transferring course switch to guide the paper money toward the temporary container in response to that the clogging detector detects the clogging of the paper money, and subsequently stops the paper money transferring operation.

8. The paper money handling apparatus according to claim 7, wherein the first paper money passage includes a switch point paper money detector for detecting the existence of the paper money at a position before, by a predetermined distance, from the transferring course switch, and the controller controls the transferring course switch to guide the paper money to the temporary container in response to that the clogging detector detects the clogging of the paper money and the existence of the paper money is prevented from being detected at the position and subsequently controls the first, second and third paper money passages to stop the paper money transferring operation.

9. The paper money handling apparatus according to claim 6, wherein controller controls the first, second and third paper money passages to transfer the paper money intermittently after restarting the paper money transferring operation, and the controller controls the first, second and third paper money passages to stop the intermittent paper money transferring operation in response to a number of times of the intermittent paper money transfers reaches a predetermined number when the switch point paper money detector detects the existence of the paper money in at least one of the fourth and fifth paper money passages.

10. The paper money handling apparatus according to claim 9, wherein the controller includes a display for displaying that the paper money exists in the third paper money passage when the number of times of the intermittent paper money transfers reaches the predetermined number.

* * * * *